US008298174B2

(12) United States Patent
Showers

(10) Patent No.: US 8,298,174 B2
(45) Date of Patent: Oct. 30, 2012

(54) APPARATUS TO ASSIST WITH PILL INGESTION

(76) Inventor: Steven J. Showers, Greensboro, NC (US)

( * ) Notice: Subject to any disclaimer, the term of this patent is extended or adjusted under 35 U.S.C. 154(b) by 6 days.

(21) Appl. No.: 12/721,055

(22) Filed: Mar. 10, 2010

(65) Prior Publication Data

US 2011/0224604 A1 Sep. 15, 2011

(51) Int. Cl.
*A61J 7/00* (2006.01)
*B65D 23/12* (2006.01)

(52) U.S. Cl. ..... 604/77; 604/58; 215/211; 215/227; 215/386

(58) Field of Classification Search ..... 604/58, 604/406; 220/129, 212, 214, 318, 375, 520–524, 220/526, 751; 222/129, 563, 566–569; 215/211, 215/213, 216, 227–228, 258, 306, 6, 11.6, 215/386–387
See application file for complete search history.

(56) References Cited

U.S. PATENT DOCUMENTS 2,919,694 A 1/1960 Gunten
2,940,447 A 6/1960 Zanegood
3,966,099 A * 6/1976 Sanford et al. ..... 222/478
4,667,818 A * 5/1987 Evans ..... 206/219
5,105,961 A * 4/1992 Noren et al. ..... 215/345
5,238,140 A 8/1993 Maze
6,386,358 B1 5/2002 North et al.
6,681,958 B2 1/2004 Sorenson et al.
6,742,678 B1 * 6/2004 Krystopik, Jr. ..... 222/481.5
7,055,709 B1 6/2006 Esau
7,431,175 B2 * 10/2008 Heilos ..... 220/717
2003/0057115 A1 3/2003 Langeler et al.
2005/0184026 A1 * 8/2005 Haley ..... 215/306
2006/0011639 A1 1/2006 Heilos

* cited by examiner

*Primary Examiner* — Quynh-Nhu H Vu
(74) *Attorney, Agent, or Firm* — James Ray & Assoc

(57) ABSTRACT

An apparatus for connection to a bottle to assist with pill ingestion includes a generally cylindrical hollow base portion manufactured from a first predetermined material and having a first predetermined size for insertion into a mouth of such bottle. A mechanism is disposed at a predetermined location on such base portion for sealingly engaging such base portion to an interior surface of such mouth of such bottle. A generally cylindrical hollow top portion is operably connected to such base portion closely adjacent an upper end of such base portion, such top portion is manufactured from a second predetermined material and has a second predetermined size and includes an open top end. A mesh material is fixedly disposed at a predetermined location within one of such base portion and such top portion for supporting at least one pill thereon.

3 Claims, 3 Drawing Sheets

APPARATUS TO ASSIST WITH PILL INGESTION

CROSS REFERENCES TO RELATED APPLICATIONS

This application is closely related to U.S. patent application Ser. No. 12/470,527 filed May 22, 2009 titled Apparatus to Assist with Pill Ingestion which is herein incorporated by reference.

FIELD OF THE INVENTION

The present invention relates generally to devices that assist with ingesting pills, such as pills, tablets, capsules, medicants, gel tabs, and the like, and more particularly, to an apparatus to assist with pill ingestion that connects to the top of a beverage bottle.

BACKGROUND OF THE INVENTION

Many people have an aversion to swallowing pills, therefore there is a need for improvement in the field.

Specifically of interest to the present invention are the following: North, et al, U.S. Pat. No. 6,386,358, discloses a tablet package which includes a predetermined number of tablets and a predetermined quantity of liquid. The package is disposable and the tablets are separated from the liquid via a breakable sheet through which the tablets may be ejected.

Esau, U.S. Pat. No. 7,055,709, discloses a stacking receptacle cap which cooperates with existing bottles and bottle caps; such receptacle cap is for holding pills separate from liquid within such bottles. The receptacle caps are stackable upon each other.

Sorenson, U.S. Pat. No. 6,681,958, discloses an apparatus and method for nesting a supplement compartment atop a lid of a liquid container.

Langeler, et al, U.S. Publication No. 2003/0057115 discloses a pill delivery system which includes a container holding a consumable substance and a specialized cap for receiving one or more pills.

Zanegood, U.S. Pat. No. 2,940,447, Gunten, U.S. Pat. No. 2,919,694, and Heilos, U.S. Publication No. 2006/0011639 all discloses drinking glasses for use in swallowing pills.

Maze, U.S. Pat. No. 5,238,140 discloses a flask which includes a pill compartment integrally formed therein separate from a fluid compartment.

None of the references cited above provides the benefits attenuate with the present invention.

SUMMARY OF THE INVENTION

An apparatus for connection to a bottle to assist with pill ingestion includes a generally cylindrical hollow base portion manufactured from a first predetermined material and having a first predetermined size for insertion into a mouth of such bottle. A means is disposed at a predetermined location on such base portion for sealingly engaging such base portion to an interior surface of such mouth of such bottle. A generally cylindrical hollow top portion is operably connected to such base portion closely adjacent an upper end of such base portion, such top portion is manufactured from a second predetermined material and has a second predetermined size and includes an open top end. A mesh material is fixedly disposed at a predetermined location within one of such base portion and such top portion for supporting at least one pill thereon.

OBJECTS OF THE INVENTION

It is, therefore, one of the primary objects of the present invention to provide a device for use in assisting an individual in swallowing a pill.

Another object of the present invention is to provide an invention which is engageable with a bottle and which supports at least one pill, such invention enabling liquid from within such bottle to pass through a portion of the invention and carry such at least one pill into the mouth of a user for swallowing.

Still another object of the present invention is to provide a device which makes it easier for a user to swallow solid medicines.

Yet another object of the present invention is to provide a device releasably engageable with a liquid holding container and which can be used over and over again as needed to assist a user in simultaneously ingesting liquid and at least one pill, tablet, capsule, gel tab, medicant, and the like.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
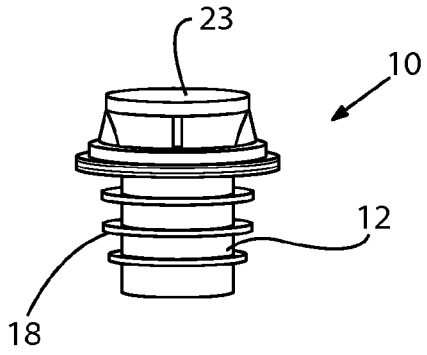
FIG. 1 is a partial perspective view of the invention according to one embodiment of the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
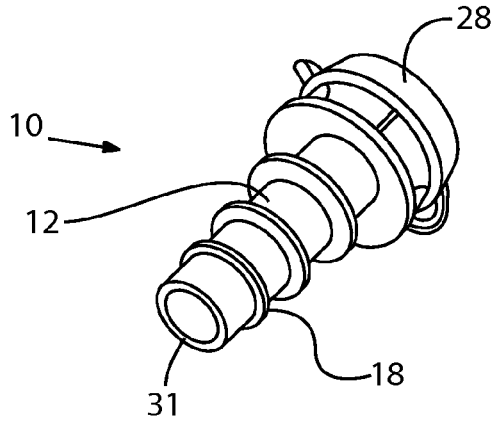
FIG. 2 is partial perspective view of the invention according to one embodiment of the invention in which mesh material is illustrated; such mesh material being for supporting at least one pill thereon.
Figure 3:
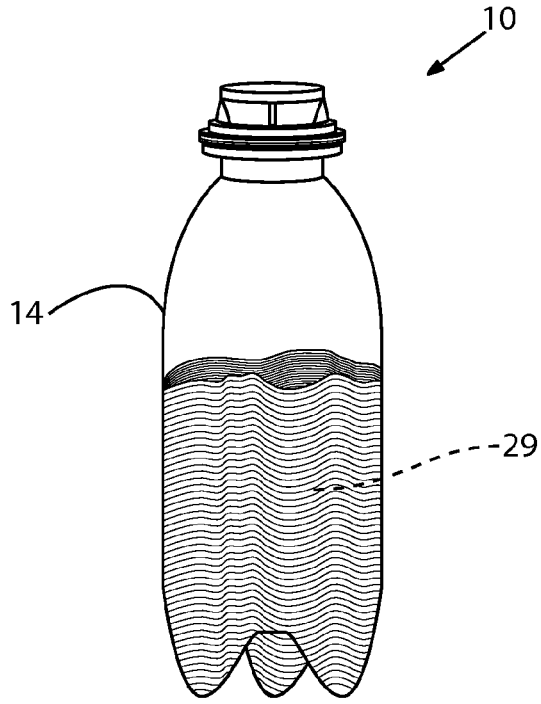
FIG. 3 is a partial perspective view of the invention according to one embodiment of the invention in which such apparatus has been engaged with a mouth of a bottle.
Figure 4:
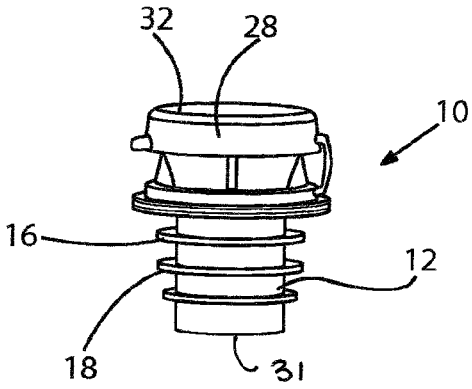
FIG. 4 is a partial perspective view of the invention according to one embodiment of the invention in which the device includes a flip top cap.
Figure 5:
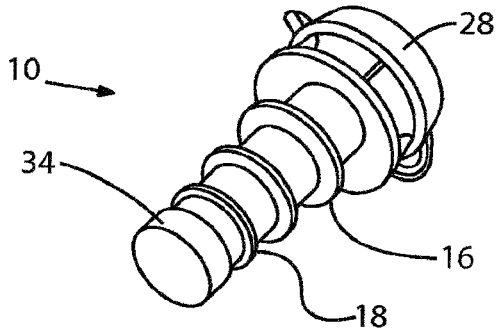
FIG. 5 is a partial perspective cut away view of the invention according to one embodiment of the invention. in which the device includes a second cover member for covering a bottom open end of the device.
Figure 7:
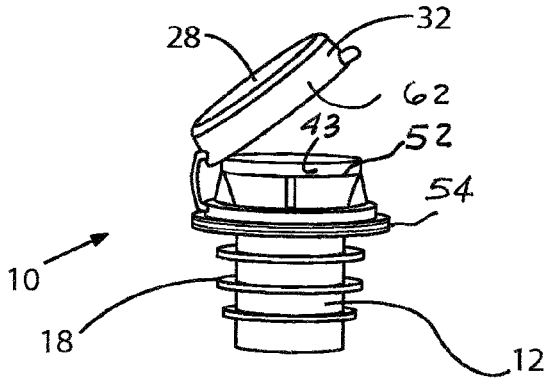
FIG. 7 is a partial perspective view of the invention depicting such flip top cap in an open position.
Figure 8:
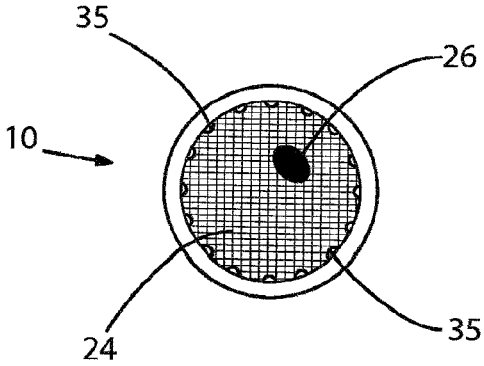
FIG. 8 is a cross sectional view of the invention along the lines of XI-XI according to one embodiment of the invention in which the mesh material is illustrated supporting a pill thereon and axial ribs are illustrated along interior walls of at least one of such top portion, such base portion and a combination thereof.
Figure 6:
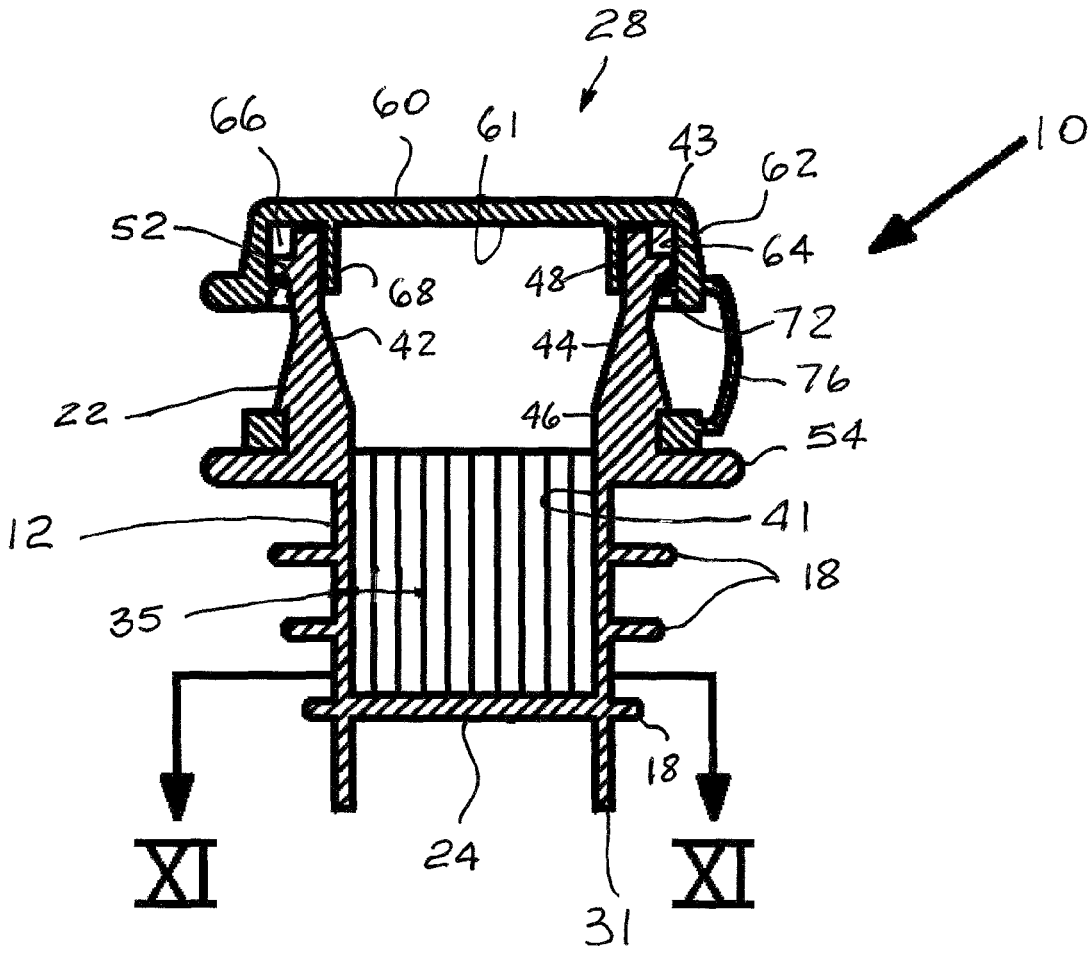
FIG. 6 is a partial perspective cut away view of the invention according to one embodiment of the invention.

Reference is now made, more particularly, to FIGS. 1-8.

An apparatus for connection to a bottle to assist with pill ingestion, generally designated 10, is provided. Such apparatus 10 includes a generally cylindrical hollow base portion 12 manufactured from a first predetermined material and having a first predetermined size for insertion into a mouth of such bottle 14. It is presently preferred that such first predetermined material is plastic. The base portion 12 defines a bottom end 31 and an upper end 41.

A means 16 is disposed at a predetermined location on such base portion 12 for sealingly engaging such base portion 12 to an interior surface of such mouth of such bottle 14. It is presently preferred that such means 16 is at least one fin 18. Preferably, such apparatus 10 includes at least three such fins 18. The bottom one of the three fins 18 is disposed in close proximity to the bottom end 31. However, the device is not meant to be limited as such and the means 16 may be a pressure fit means or any other type of means which reasonably facilitates such a purpose.

A generally cylindrical hollow top portion 22 is operably connected to such base portion 12 closely adjacent the upper end 41 of such base portion 12, such top portion 22 is manufactured from a second predetermined material and has a second predetermined size and includes an open top end. It is presently preferred that such second predetermined material is plastic.

The top portion 22 has an inner peripheral surface 42 defined by a middle tapered portion 44 disposed between a pair of straight portions 46 and 48. Top portion 22 also has a first annular abutment 52 disposed on the outer surface 50 thereof.

An annular flange 54 is disposed on the outer peripheral surface of the apparatus 10 above the top sealing fin 18.

A mesh material 24 is fixedly disposed at a predetermined location within one of such base portion 12 and such top portion 22 for supporting at least one pill 26 thereon. By way of example of FIG. 6, the mesh 24 is disposed in close proximity to the bottom end 31 of the base portion 12 in general alignment with a bottom one of the fins 18. Such at least one pill 26 may be any type including, but not limited to at least one pill, at least one capsule, at least one geltab, at least one tablet, at least one medicant, and the like. It is meant that the term "pill" cover any type of solid and semi-solid medicine. It is presently preferred that such mesh material 24 is at least one of wire, plastic, fabric, and a combination thereof.

It is presently preferred that such apparatus 10 includes a first cover member, generally designated as 28, sealingly engageable with such open top end 23 of such top portion 22 of such apparatus 10 for retaining any unused portion of fluid 29 remaining within such bottle 14 when such apparatus 10 is connected to such bottle 14. Preferably such first cover member 28 is a flip top cap 32.

More specifically, cover 28 includes a generally round base 60 and a peripheral wall 62 upstanding on the generally round base 60. The peripheral wall 62 is sized so as to receive the upper portion 22 therewithin. A peripheral gap 66 is defined between an outer peripheral surface 43 of the upper portion 22 and an inner surface 64 of the peripheral wall 62 of the cover 28. A ring 68 upstands on an inner surface 61 of the base 60 of the cover 28, the ring 68 is so sized that an outer surface thereof is disposed within an inner peripheral surface 42 of the upper portion 22.

There is also a second annular abutment 72 that is disposed on an inner surface 64 of the peripheral wall 62 of the cover 28 in contact with the first annular abutment 52 of the top portion 22. Both annular abutments 72 and 52 are disposed within the peripheral gap 66. An elongated strap 76 has a first end thereof attached to an outer surface of the peripheral wall 62 of the cover 28 and has an opposite second end thereof attached to the upper portion 22.

It is further presently preferred that such apparatus 10 also includes a second cover member 34 releasably connectable to an open bottom end 31 of such base portion 12 for preventing at least one of dust, liquid, dirt, debris, and a combination thereof from entering through such open bottom end of such base portion 12 when such apparatus 10 is not connected to such bottle. It is meant that such first and second cover members be used to cover the open ends of the apparatus 10 such that such at least one pill 26 may be transported securely within the apparatus 10, such cover members not only preventing such at least one pill from leaving the confines of the apparatus 10, but also preventing dirt, dust, debris, liquids, etc. from contaminating such at least one pill.

It is presently preferred that an interior cavity of at least one of such top portion 22, such base portion and a combination thereof includes a plurality of axial ribs 35 disposed along interior walls thereof for preventing such at least one pill from sticking to such interior walls when such pill is wet. It is meant that when ready to consume such at least one pill a user (not shown) will remove or open such cover members (if applicable), insert such base portion into the mouth of such bottle, place such at least one pill on such mesh material if not already positioned thereon, place his or her lips closely adjacent such open top end of such top portion, and tilt such bottle such that liquid from within such bottle passes through such mesh material to carry such at least one pill along with such liquid into such user's mouth wherein such at least one pill may be swallowed along with such liquid.

It is presently preferred that such apparatus 10 is reusable.

It is presently preferred that such apparatus 10 is dishwasher safe for easy cleaning.

According to one embodiment, such apparatus 10 is in combination with a bottle.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. An apparatus for connection to a bottle to assist with pill ingestion comprising:

a. a generally cylindrical hollow base having each of inner peripheral surface, an outer peripheral surface, a bottom end and an upper end;

b. a means disposed at a predetermined location on said base portion for sealingly engaging said base portion to an interior surface of such mouth of such bottle;

c. a generally cylindrical hollow top portion operatively connected to said base portion closely adjacent said upper end thereof;

d. an annular flange disposed on an outer peripheral surface of said apparatus in abutting engagement with a rim of the bottle;

e. a mesh member fixedly disposed in a plane being generally transverse to a length of said base portion in close proximity to said bottom end of said base portion;

f. a first annular abutment disposed on an outer surface of said top portion, and g. a cover including:

(i) a generally round base, (ii) a peripheral wall upstanding on said generally round base, said peripheral wall is sized so as to receive said top portion therewithin, (iii) a peripheral gap defined between an outer surface of said top portion and an inner surface of said peripheral wall of said cover, (iv) a ring upstanding on an inner surface of said base of said cover, said ring is so sized that an outer surface thereof is disposed in close proximity to an inner surface of said top portion, (v) a second annular abutment disposed on an inner surface of said peripheral wall of said cover in direct contact with said first annular abutment, wherein said first and second annular abutments are disposed within said peripheral gap, and (vi) an elongated strap having a first end thereof attached to an outer surface of said peripheral wall and having an opposite second end thereof attached to said top portion.

2. An apparatus according to claim 1 wherein said means for sealingly engaging said base portion to an interior surface of such mouth of such bottle includes three annular sealing fins disposed in spaced apart relationship along a length of said base portion on said outer peripheral surface thereof, each of said three annular sealing fins has a different outer diameter, wherein said mesh is disposed in general alignment with a bottom one of said three annular sealing fins when said apparatus is inserted into the bottle.

3. An apparatus according to claim 1 wherein said apparatus further includes a plurality of axial ribs disposed on inner peripheral surfaces of at least one of said base portion, said top portion and combination thereof.

* * * * *